US006056057A

United States Patent [19]

Vinegar et al.

[11] Patent Number: 6,056,057

[45] Date of Patent: May 2, 2000

[54] HEATER WELL METHOD AND APPARATUS

[75] Inventors: Harold J. Vinegar; Thomas Mikus; John Michael Karanikas; Scott Lee Wellington, all of Houston, Tex.

[73] Assignee: Shell Oil Company, Houston, Tex.

[21] Appl. No.: 08/950,480

[22] Filed: Oct. 15, 1997

Related U.S. Application Data

[60] Provisional application No. 60/028,376, Oct. 15, 1996.

[51] Int. Cl.[7] ..... E21B 36/02

[52] U.S. Cl. ..... 166/302; 166/303; 166/57; 166/272.1; 299/14

[58] Field of Search ..... 166/302, 303, 166/272.1, 57, 245, 52; 299/14

[56] References Cited

U.S. PATENT DOCUMENTS

| | | | |
|---|---|---|---|
| 1,342,741 | 6/1920 | Day | 166/303 |
| 2,902,270 | 9/1959 | Salomonsson et al. | 166/38 |
| 3,095,031 | 6/1963 | Eurenius et al. | 158/59 |
| 3,181,613 | 5/1965 | Krueger | 166/300 |
| 5,392,854 | 2/1995 | Vinegar et al. | 166/272.1 |

FOREIGN PATENT DOCUMENTS 123137 11/1948 Sweden .

*Primary Examiner*—David Bagnell
*Assistant Examiner*—Chi H. Kang

[57] ABSTRACT

A method and apparatus is disclosed for heating of formations using fired heaters. Each fired heater may consist of two concentric tubulars emplaced in the formation, connected via a wellhead to a burner at the surface. Combustion gases from the burner go down to the bottom of the inner tubular and return to the surface in the annular space between the two tubulars. The two tubulars may be insulated in an overburden zone where heating is not desired. A plurality of fired heaters can be connected together such that the combustion gases from a first fired heater well are piped through insulated interconnect piping to become the air inlet for a second fired heater well, which also has a burner at its wellhead. This can be repeated for other heater wells, until the oxygen content of the combustion gas is reduced near zero. The combustion gas from the last fired heater well may be routed through a heat exchanger in which the fresh inlet air for the first heater well is preheated. A substantially uniform temperature is maintained in each heater well by using a high mass flow into the heater well.

12 Claims, 7 Drawing Sheets

HEATER WELL METHOD AND APPARATUS

RELATED APPLICATIONS

This application is a continuation of provisional application Ser. No. 60/028,376 filed Oct. 15, 1996.

FIELD OF THE INVENTION

The present invention relates to a method and apparatus to heat subterranean formations.

BACKGROUND TO THE INVENTION

Numerous applications exist in oil production and soil remediation where it is desired to uniformly heat thick sections of the earth using thermal conduction. In the case of oil production, there exist enormous worldwide deposits of oil shale, tar sands, lipid coals, and oil-bearing diatomite where uniform heating of the hydrocarbonaceous deposit by thermal conduction can be used to recover hydrocarbons as liquids or vapor. The thickness of the deposits can be hundreds of feet thick, and lie beneath overburden hundreds of feet thick. In the case of soil remediation, uniform heating of the soil by thermal conduction can vaporize contaminants and drive them to production wells, or even destroy the contaminants in situ. Here, the contamination can extend from the soil surface down hundreds of feet.

Electric heat can be used for uniform heating of thick earth formations by thermal conduction, as is well known in the art. However, electric heating is generally expensive due to a higher per-BTU cost of electricity as opposed to hydrocarbon fuels. This relatively high energy cost can unfavorably affect the economics of oil recovery and soil remediation. Heat by combustion of natural gas is substantially less expensive and is therefore generally preferred to electric heat. However, it is difficult to uniformly heat thick earth formations, especially when those formations are below overburdens of hundreds of feet. This is particularly true when injection of 300 watts/ft or more heat to the earth formation is desired. This can be the case in oil production and soil remediation heat injection applications.

Existing burner technology would result in large temperature variations between the top and bottom of the heated interval and non-uniform heating of the earth formation. Examples of burners suggested for such services include Swedish patent No. 123,137, and U.S. Pat. Nos. 2,902,270 and 3,095,031. These burners have flames within wellbores. The radiant heat source within the wellbores requires that expensive materials be used for major portions of the wellbore tubulars. With downhole gas-fired burners, the well casing adjacent to the burner becomes significantly hotter than the average well temperature, resulting in early casing and burner failures unless very expensive materials are utilized. This problem is exacerbated because the typical heating time in oil recovery applications may be two years or longer. In applications with thousands of such wells operating simultaneously (such as recovery of hydrocarbons from oil shale) the gas burners must be easy to maintain and preferably maintenance free. Further, coke formation within the fuel gas conduits would be a significant problem in operation of such burners.

U.S. Pat. No. 3,181,613 suggests utilizing an ignition propagation rod (a ceramic, glass or sintered metal rod placed within a burner tube) to extend the flame over a longer distance within a wellbore. Such a flame-holding rod aids in extending the flame down the wellbore, but results in a flame that is difficult to control in that limited degrees of freedom are available for controlling the temperature and the distribution of heat within the wellbore. Further, if combustion gases return up the wellbore, heat exchange between the combustion gases and the fuel and combustion air could result in autoignition of the combined combustion air and fuel stream.

A wellbore heater with greater control over the distribution of heat within the wellbore would be desirable. In the case of oil production from oil shale, non-uniform heating of the oil shale reservoir results in some oil shale not reaching retorting temperature, and overheating other parts of the oil shale, which negatively affects the economics.

It is therefore an object of the present invention to provide a method and an apparatus to heat a formation wherein burners and controls can be located exclusively at the surface, and wherein materials below the surface are not exposed to flames.

SUMMARY OF THE INVENTION

These and other objects are accomplished by a method to heat a formation, the method comprising the steps of:

- providing a plurality of wellbores within the formation to be heated, each of the wellbores comprising a combustion gas flowpath through which a fluid can be routed, the combustion gas flowpath having an inlet and an outlet;
- supplying to an inlet of a first wellbore combustion gas flowpath a flow of air;
- burning an amount of fuel in the flow of air, thereby forming a stream of combustion products, the amount of fuel resulting in the stream of combustion products being at a first initial temperature;
- passing the stream of combustion products through the first wellbore combustion gas flowpath, thereby transferring heat from the stream of combustion products to the formation, and decreasing the temperature of the stream of combustion products from the first initial temperature to a first final temperature;
- routing the stream of combustion products to a second wellbore combustion gas flowpath inlet;
- burning a second amount of fuel in the stream of combustion products, thereby forming a second stream of combustion products, the second amount of fuel resulting in the second stream of combustion products being at a second initial temperature, the second initial temperature being essentially the same temperature as the first initial temperature; and
- passing the second stream of combustion products through the second wellbore combustion gas flowpath, thereby transferring heat from the second stream of combustion products to the formation, and decreasing the temperature of the second stream of combustion products from the second initial temperature to a second final temperature.

A series of fired heaters are provided, each preferably has two concentric tubulars emplaced in the earth, connected by a wellhead to a gas burner at the surface. Exhaust gases from the burner go down to the bottom of the inner tube and return to the surface in the annular space. The two tubulars may be insulated in an overburden zone where heating is not desired. A plurality of fired heaters are connected together in a pattern such that the hot exhaust from a first fired heater well is piped through insulated interconnect piping to become an inlet for a second gas heater well, which also has a gas burner at or near its wellhead. This is repeated for a plurality of wells, until the oxygen content of the exhaust gas is reduced near zero. The exhaust from the last gas-fired heater well in the pattern can exchange heat with combustion air for the first well, thus maintaining a high heat efficiency for the plurality of heater wells. A substantially uniform temperature is maintained in each heater well by using a high mass flow into the wells.

An additional advantage of the present invention is ease of maintenance relative to downhole gas-fired heaters. Other advantages are that internal tubulars in the heater well of the present invention are reusable and that surface burners may be serviced without removing the downhole tubulars from the well. Furthermore, the burners could be installed so that one burner may be serviced without shutting down the other heater wells in the pattern.

Another advantage of the present invention is reliability of the heater pattern with respect to failure or plugging of one or more surface burners in the pattern. Because of the design of the heater well pattern, a particular heater well will stay close to operating temperatures during time periods when its surface burner is being serviced or replaced. This is true even if a particular surface burner is not in operation for a prolonged time. If one burner fails, the mass flow from the preceding burner will still keep the well at high temperature, and additional fuel injected by the system controller into the next downstream heater well will make up for the drop in temperature of the exhaust from the well with the inoperative surface burner. This redundancy feature is a significant advantage over individual non-connected heater wells, each of which would cool down rapidly if its surface burner fails.

Another advantage of the present invention is that if one surface burner should remain inoperative for a long time, the adjacent heater wells may be able to supply more heat over this time to compensate. This is because the heater wells may be temperature controlled, and if one well in the pattern is delivering reduced heat, the earth formation of that pattern will be somewhat colder, allowing the other heater wells to inject more heat at the same well temperatures (well metallurgical limits dictating the maximum temperature at which heat can be injected into the formation from a particular heater well).

A single wellbore can alternatively be heated by an individual heater, and exhaust gases from the burner circulated down the wellbore and back to the surface wherein the exhaust gases can be vented. In this embodiment, it is preferable that a heat exchanger be provided to exchange heat between exhaust gases and combustion air.

DESCRIPTION OF A PREFERRED EMBODIMENT

Figure 1:
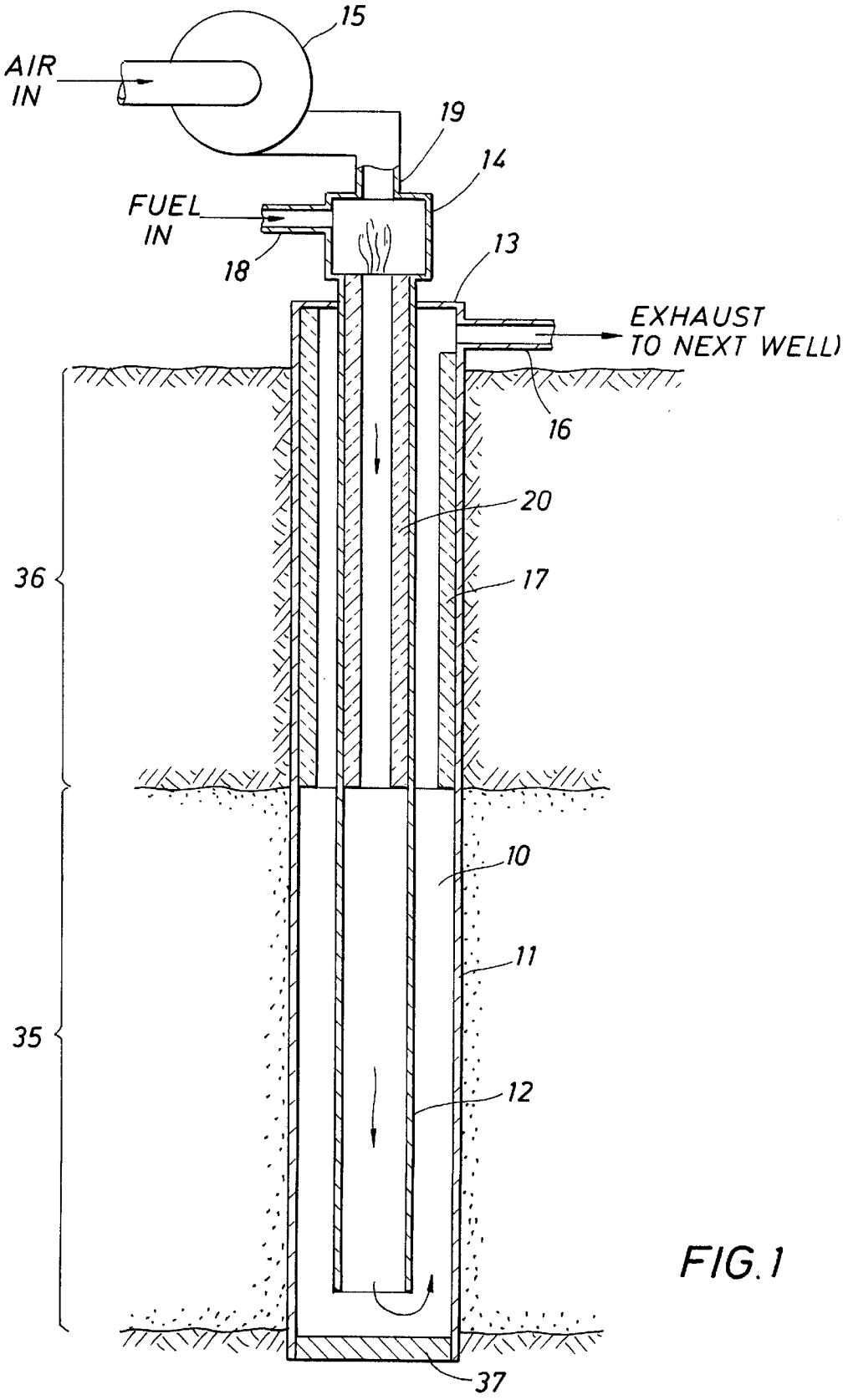
FIG. 1 is a schematic drawing of a gas-fired heater well with two tubulars useful in the practice of the present invention.

Referring now to FIG. 1, there is shown a heater well 10, including a casing tubular 11 which is sealed at the bottom with a cement or metal plug 37. The heater well traverses an overburden 36 and a target formation 35. A combustion gas flowpath tubular 12 inside the casing extends to near the bottom of the target formation. The combustion gas flowpath is open at the bottom, and a volume within the combustion gas flowpath tubular is therefore in communication with the annular volume surrounding the combustion gas flowpath tubular. A wellhead 13 at the surface seals the casing. A burner 14 is attached to the wellhead. Inlet air from air source 15 (blower shown) supplies inlet air to the burner through the wellhead. Combustion gases from the burner are preferably at a temperature between about 1400° F. and about 2000° F., and preferably leave the overburden section 36 at a temperature of about 1800° F. with little heat loss in the overburden because insulation 20 is provided between the tubular and the annular volume surrounding the tubular, inside of the casing 11. In the formation to be heated 35 the combustion gases go to the bottom of the heater well, losing temperature as heat is transferred to the target formation 35, and return to the surface through the annular volume. At the bottom of the well the combustion gases are at a temperature of about 1600° F. because of heat transferred from the combustion gases to the formation. Throughout the target formation the combustion gas flowpath tubular transmits heat radiatively to the casing, and heat is transferred from the casing to the target formation conductively. Heat is also transferred to the casing by turbulent convection from the flow of combustion gases. Combustion gases exit the wellhead at a temperature in excess of about 1550° F. through exhaust port 16. A substantially uniform temperature is maintained in each heater well by using a high mass flow into the well in conjunction with the counter current flow in the concentric tubes.

The casing and flowline tubular may be insulated in an overburden zone by insulation 17 to reduce heat losses to the overburden. Insulation may be either inside or outside of the tubular, and similarly inside or outside the casing. Insulating cement 27 in the overburden zone can further reduce heat losses in the overburden, and may be sufficient as the only insulation between the hot gases and the overburden. This insulating cement can use lightweight aggregate, such as, for example, bubble alumina or exfoliated vermiculite, with a high water content, and will typically have a slurry density of about 10 to 12 pounds per gallon. Alternatively, a foamed cement could be utilized (with or without low density aggregate). The borehole may be drilled such that the hole diameter in the overburden is larger than in the target zone, to increase the thickness of insulating cement. Foamed low density insulating cements are preferred as the insulating cements because foamed cements can generally be provided at lower cost.

Casing may be installed in the ground by drilling a hole of larger diameter (typically 2 to 3 inch larger outside diameter) than the casing, inserting the casing in the hole, and cementing the space between the earth and the casing with a refractory cement 28. In the target zone, where high thermal conductivity is desired, the refractory cement can be a pumpable, high density, alumina cement or other high heat conductivity cement. These high heat conductivity cements typical have slurry densities of 17 to 22 pounds per gallon. Because thermal conductivity of the refractory cement can be considerably greater than the formation thermal conductivity, it can be advantageous to provide a borehole that is of considerably greater diameter than that required for the casing.

In shallow wellbores (about 400 feet or less), earth stresses can be low enough that support from cement is not required for a casing. When cement is not used, it is preferred that the casing be of at least six inches in outside diameter. The larger diameter casing provides for an acceptable rate of heat transfer into the formation. Another advantage of providing a casing that is not cemented is the possibility of removing the casing from the formation when the heating process is completed. Even if the casing is cemented into the overburden, a low density cement such as the cement preferred for use in the overburden will be readily overdrilled or otherwise broken free from the casing.

When the casing is cemented into the formation to be heated, it is preferred that a low tensile strength material between the casing and the formation be included to facilitate removal of the casing. The low tensile strength material can be fractured by pulling or rotating the casing, and then the casing can be removed from the wellbore.

The casing 11 is preferably constructed of a high temperature metal in the target zone, where casing temperatures may be hotter than 1400° F. Typical high temperature metals may be, for example, 304 or 304H stainless steel, "INCOLOY 800H", "MA 253", "HAYNES HR-120", or other alloys selected for acceptable corrosion and creep resistance at high temperatures. In another embodiment, an expendable casing may be used. In this embodiment, the casing material is made from a relatively inexpensive metal but is sufficiently thick that it will be intact in spite of significant corrosion. If earth stress in the formation are low, cement need not be placed around the casing in the heating zone, but is preferably casing in the overburden is cemented to seal the borehole, and to provide additional insulation.

In a preferred embodiment, the casing is of all-welded construction, to minimize the possibility of leaks at high temperature, although threaded joints could be used. The casing may be welded together as it is inserted into the hole, or could be pre-welded and coiled and inserted as a coiled tubing. The section of casing in the overburden should not experience high temperatures, i.e., temperatures above about 400° F., because of internal insulation 22, and may be constructed, for example, from carbon steel such as K-55, to reduce costs, although a high temperature metal could also be utilized. Again, welded construction is preferred although special threaded joints could also be used.

Size and wall thickness of the casing depends on the depth of the well, as will be explained later in this application. For example, for a 50 foot thick target formation, the casing in the target section may be 304H stainless steel with a 4 inch outside diameter with a 0.180 inch wall thickness, while with a 50 to 200 foot thick overburden the casing in the overburden may be the same dimensions but K-55 material.

Combustion gas flowpath tubular 12 should be constructed of high temperature metal over its entire length. Again, welded construction is preferred, and the tubular may be welded as it is inserted into the well or could be prewelded and inserted as a coiled tubing. Typical metals may be, for example, 304 or 304H stainless steel, "INCOLOY 800H", "MA 253", "HAYNES HR-120", or other alloys having acceptable corrosion and creep resistance at high temperature.

The combustion gas flowpath tubular may also contain a temperature sensing means (not shown) in the target zone to be used in conjunction with a system controller to regulate the temperature of the heater well. The temperature sensing means may be, is for example, a thermocouple with a probe welded to the outside of the combustion gas flowpath tubular or the casing within the target formation. A plurality of thermocouples may be used at different depths to establish the temperature profile in the well as well as providing redundancy. Alternatively, a traveling thermocouple may be employed. The traveling thermocouple may be inserted through the wellhead into the annular space between the combustion gas flowpath tubular and the casing. Another possibility is to use a fiber optic cable for permanent temperature profiling by laser scattering.

The combustion gas flowpath tubular preferably contains insulation 17 to reduce heat losses into the overburden. The insulation may be either internal to the tubular or external. The section of the combustion gas flowpath tubular in the overburden may require a higher performance metal alloy than the target formation section if the combustion gas flowpath tubular is insulated externally. For example, "INCOLOY 800H" or "MA 253" could be used in the overburden section and 304 stainless in the target formation section. The insulation may be fibrous alumina or aluminosilicate insulation or cement. For example, in the preferred embodiment the combustion gas flowpath tubulars are lined internally with FIBERFRAX™ insulation bonded to the tubular (available from Metaullics, Inc. of Solon, Ohio). Alternatively, Carborundum, Inc., Fibers Division, of Niagara Falls, N.Y., manufactures a moldable LDS ceramic fiber insulation which can be used to internally or externally insulate the combustion gas flowpath tubular by pumping or grouting. Still another possibility is to externally insulate the combustion gas flowpath tubular by wrapping FIBERFRAX™ (Carborundum) ceramic fiber around the combustion gas flowpath tubular and tie wrapping the insulation tight with high temperature metal wire, for example, nichrome wire. The thickness of the air line insulation may be, for example, one quarter to one half of an inch thick with a K value of about 0.13 W/m-° C. at 1600° F. The combustion gas flowpath tubular may be constructed of relatively expensive alloys because it is retrievable and reusable on other wells in the project.

Internal insulation of the casing is preferred so that the casing in the overburden section can be constructed of carbon steel to minimize costs. The internal insulation may be of the same type as the combustion gas flowpath tubular, e.g., internal FIBERFRAX™ insulation bonded to the carbon steel (Metaullics, Inc. of Solon, Ohio); moldable LDS ceramic fiber insulation (carborundum); or ceramic tube inserts that tightly fit inside the casing (laminated FIBERFAX™ product sold by Metaullics, Inc.). The thickness of the tubular insulation may be, for example, one half to one inch thick with a K value of about 0.13 W/m-° C. at 1600° F.

A plurality of heaters may be connected together such that the hot exhaust from a first heater well is piped through insulated piping to become the air inlet for a second heater well, which also has a burner on its wellhead. The wellhead 13 contains a flange, onto which the burner 14 may be bolted for later removal. The wellhead also contains the exhaust port 16 which connects to the interconnect piping to the next well. The wellhead may be constructed of carbon steel with internal thermal insulation.

The burner may be a conventional gas-fired burner with fuel inlet 18 and air inlet 19 ports. The fuel is injected into the air stream through one or more nozzles. Typical burners of this type are routinely used as duct burners and are available from companies such as John Zink, Inc. of Tulsa, Okla. and Maxxon, Inc. of Chicago, Ill. The burner may include a flame-out detector (not shown) which may be, for example, a detector of the ultraviolet light, thermocouple, or ceramic-insulated resistivity types. The burner may also contain a pilot flame for ignition, although electronic ignition is a preferred alternative. The burner may be constructed, for example, with a carbon steel body with a ceramic insulated lining.

In the design of the burner, the fuel nozzle is preferably recessed into the burner body and retractable from the burner body for easy maintenance. A valve can be used to seal the recessed volume while the nozzle is removed. This allows hot gases from the upstream well to continue flowing through the well during maintenance on the gas burner nozzle, should the nozzle become plugged or coked.

Figure 2:
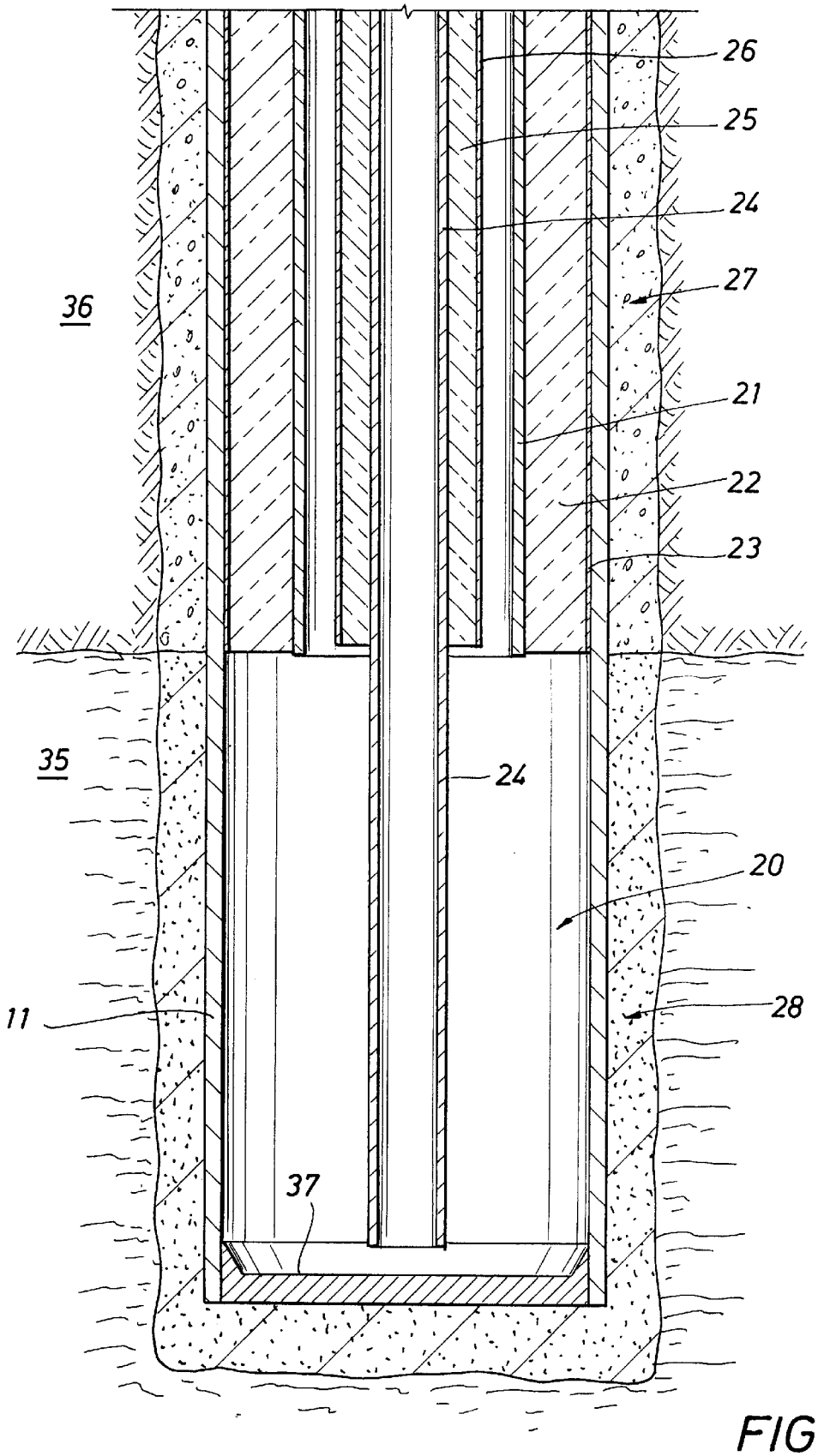
FIG. 2 is a cross section of an alternate embodiment of a gas-fired heater well useful in the present invention.

Referring now to FIG. 2, there is shown a gas-fired heater well 20 of this invention using three concentric tubulars. A middle tubular 21 extends only through the overburden 36. An inner tubular, the combustion gas flowpath tubular 24 extends to near the bottom of the target formation 35, where the volume inside the tubulars are sealed by a cement plug 37. This heater well design may be operationally simpler to install and less expensive than the heater well design in FIG. 1. The middle tubular acts as support for the internal insulation of the casing. Fibrous ceramic insulation 22 such as FIBERFRAX™ is wrapped on the middle tubular so as to fill substantially the space between the middle tubular and the inside of the casing and prevent air flow in this space. FIBERFRAX™ (carborundum) ceramic fiber can be wrapped around the tubular and the insulation tie wrapped with high temperature metal wire, for example, nichrome wire. A thin stainless steel cowling 23 outside this insulation may prove more durable in installation. The thickness of the middle tubular insulation may be, for example, one half to one inch thick and may have a K value of about 0.13 W/m-° C. at 1600° F. In this design the middle and inner tubulars may both be externally insulated, and the exhaust air flows between the middle and inner tubulars. The middle tubular is constructed of a high temperature metal such as, for example 304 or 304H stainless steel, "INCOLOY 800H", "MA 253", or "HR-120". A similar design may be used for the combustion gas flowpath tubular 24 and insulation 25 with cowling 26. Both inner and middle tubulars may be removed for use in another wellbore when the heating of the earth formation is completed.

The insulation 25 around the combustion gas flowpath tubular may be extended into the region to be heated to improve distribution of heat into the formation to be heated. Extending the insulation 25 around the combustion gas flowpath tubular also improves the thermal efficiency of the heat injection process by decreasing the temperature of the exhaust gases leaving the formation to be heated.

Insulation could additionally be added to either or both of the tubulars to improve distribution of heat when the formation contains layers that have greater heat conductivity than the surrounding layers of the formation. This insulation could be provided with varying thickness. When insulation is provided within the formation to be heated to improve distribution of heat, the insulation may be provided as a movable sleeve, so that the position of the insulation can be adjusted to better align with regions of greater conductivity. Such sleeves of insulation could be, for example, supported by cables from the surface. When it is known that regions of greater conductivity exist prior to cementing a casing into the wellbore, a cement of lesser thermal conductivity could be placed in these regions.

Figure 3:
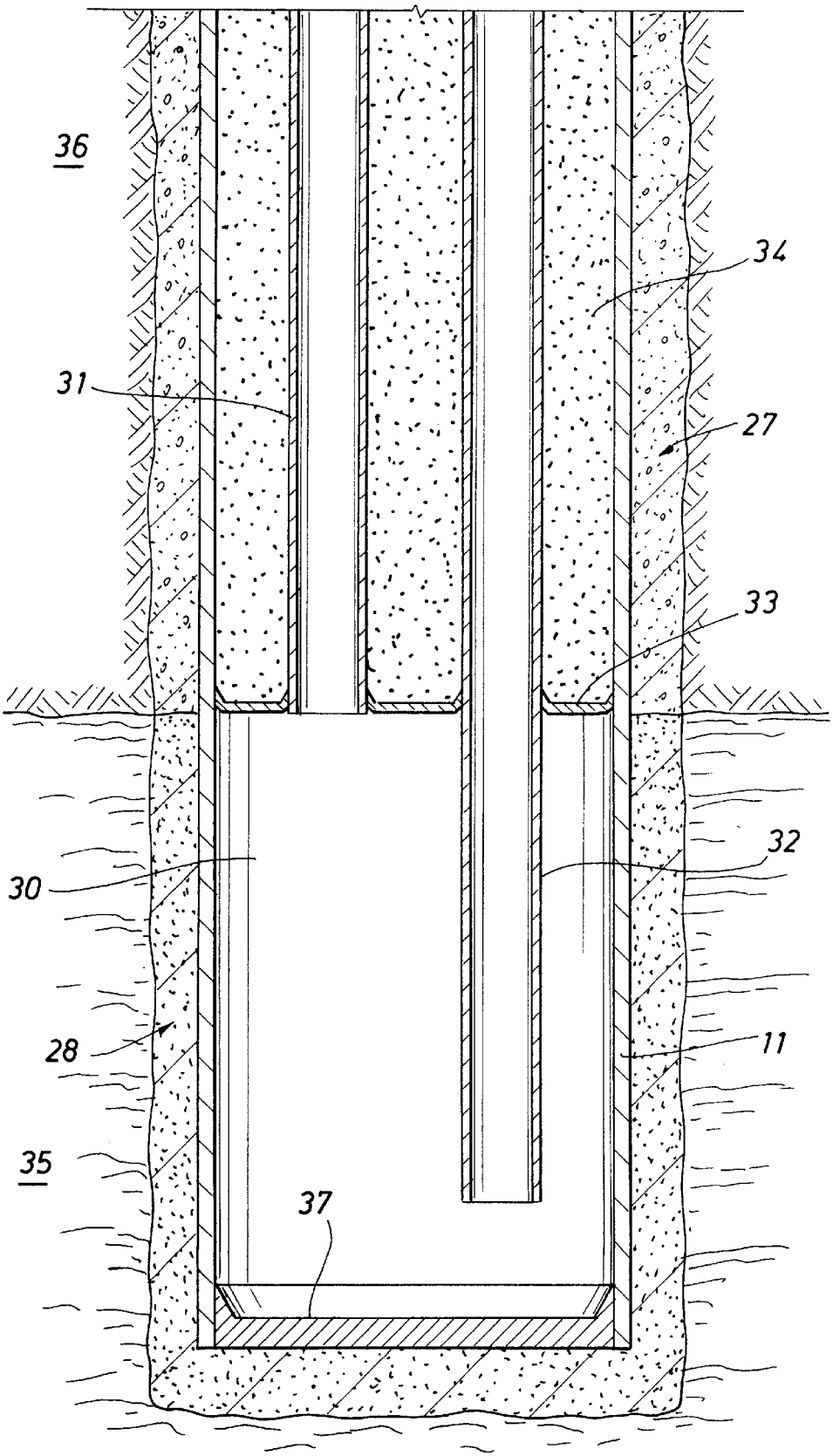
FIG. 3 is a cross section of another embodiment of the gas-fired heater well useful in the present invention.

Referring now to FIG. 3, a gas-fired heater well 30 of this invention using side-by-side tubulars inside a casing 11 is shown. The shorter tubular 31 extends only through the overburden 36, while the longer tubular 32 extends to the bottom of the target formation 35. The shorter tubular is equipped with a cement catcher 33 emplaced at the bottom of the overburden, which makes a seal between the inside of the casing and the outside of the two side-by-side tubulars. The tubulars are preferably of welded construction, and may be installed simultaneously as coiled tubing from two coiled tubing reels. The two tubulars need not be the same diameter, and may be optimized for lowest overall pressure drop. After installation of the two tubulars, insulation 34 such as, for example, a granular insulation such as vermiculite, or an insulating cement can be poured into the casing to fill the overburden section above the cement catcher. Granular insulation is preferred because the two tubulam can be removed from the well after the heating process is complete. In this design both the long and short tubulars should be constructed from high temperature metal such as 304 or 304H stainless steel, "INCOLOY 800H", "MA 253", or "HAYNES HR-120". This heater well design may be less expensive than the heater well design utilizing cement because vermiculite insulation is very inexpensive, although the side-by-side tubulars are operationally more complicated to install. The design utilizing loose vermiculite is also preferred because of the possibility of mechanical damage from significant differential expansion between the two side-by-side tubulars when the tubulars are secured by cement. To overcome this problem, the side-by-side tubulars could be free hanging with respect to each other and the casing, and simply wrapped with their own separate fibrous insulation. In this case, the cement catcher 33 could be replaced with, for example, a ceramic fiber packing to prevent flow in the space between the two tubulars.

Figure 4:
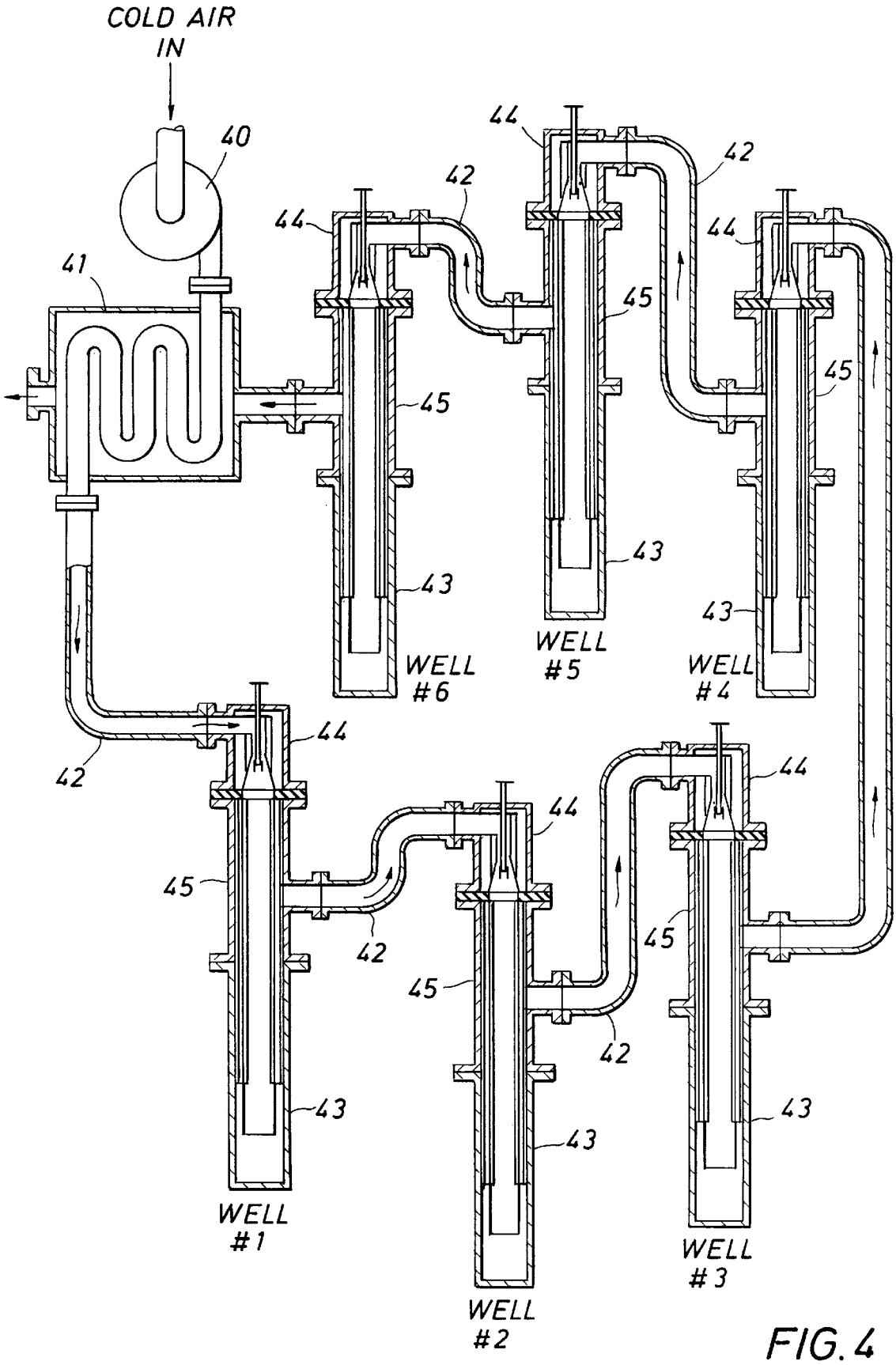
FIG. 4 is a schematic drawing of six gas-fired heater wells with a heat exchanger to exchange heat between combustion products and combustion air.

Referring now to FIG. 4, six heater wells of the present invention configured in an interconnected pattern are shown. The pattern is fed fresh air from a blower 40. Combustion air passes through a heat exchanger 41 and is preheated before reaching the first heater well. A plurality of heater wells 43 are connected together such that the hot exhaust from a first heater well is piped through insulated (insulation not shown) interconnect piping 42 to become the air inlet for a second heater well, which also has a gas burner 44 on its wellhead 45. Oxygen content of the exhaust gas is reduced near zero at the last heater well in the series. For example, if the pattern consists of six wells, each well may combust about three percent by volume of oxygen from the combustion air or combustion products stream going to the burner. After the sixth well the oxygen content of the combustion air would be reduced to about three percent. The exhaust from the last heater well goes to a heat exchanger 41 through which the inlet air for the first well is preheated, thus maintaining a relatively high heat efficiency for the heater wells. Exhaust gas from the heat exchanger can be maintained above the dew point to prevent condensation in the exhaust stack (not shown) and heat exchanger.

The insulated interconnect piping 42 may be insulated internally or externally, in a similar manner to the downhole insulation. However, because saving space in not as important as in the case of downhole insulation, the insulation thickness for the interconnect piping may be, for example, 2 to 3 inches in thickness. Again, if the insulation is internal, the piping may be made of carbon steel, whereas if the insulation is external, a high temperature metal such as 304 stainless is preferred for corrosion resistance.

The length of the interconnect piping is determined by the spacing between heater wells, typically 15 to 30 feet. The optimum spacing between heater wells is, in turn, determined by target thickness. The interconnect piping should be as short as possible to minimize heat losses between heater wells.

Figure 5:
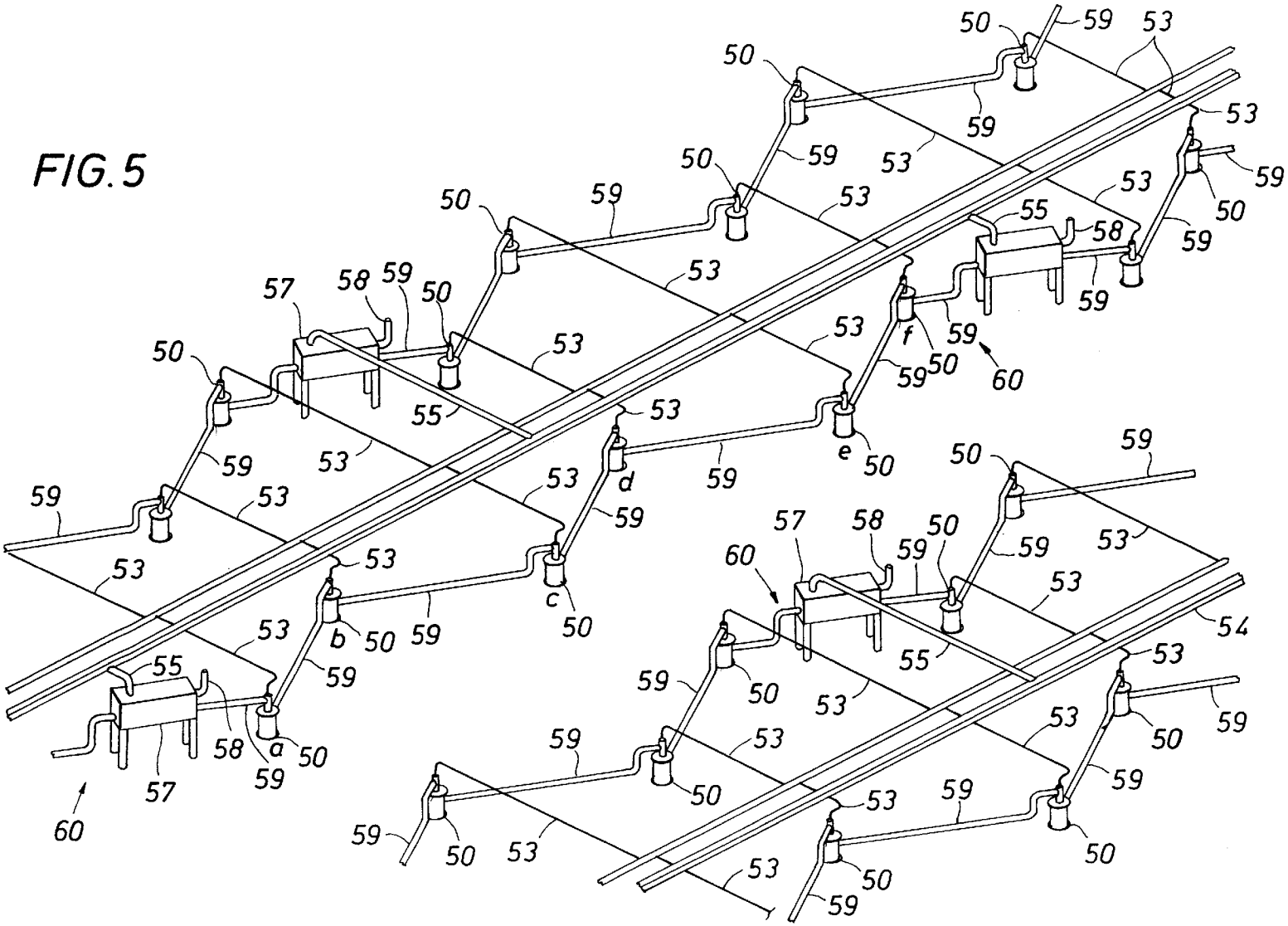
FIG. 5 is an isometric view of a typical field layout of gas-fired heater wells in the practice of the present invention.

Referring now to FIG. 5, an exemplary field layout of surface equipment associated with heater wells of this invention is shown. Here the heater wells 50 are arranged in a hexagonal "7-spot" with a production well (not shown) at the center of each hexagon. However, heater wells are connected in series (for combustion gas flow), labeled a-f, in a staggered line pattern. Exhaust from the first pattern is fed to the inlet heat exchanger of the next pattern along the line through combustion gas headers 60. This "line-pattern" layout allows free access to any of the heater wells without crossing over any fuel, air, production, or interconnect piping. Fuel is fed to the burners from a main fuel line 52 via takeoff taps 53. Simiarly, the main air delivery can be through a pressurized air line 54 with takeout taps 55 entering each heat exchanger. Oil production from the production wells is piped to a production line (not shown) for collection. The heat exchanger 57 from each pattern exhausts via stack 58.

Figure 6:
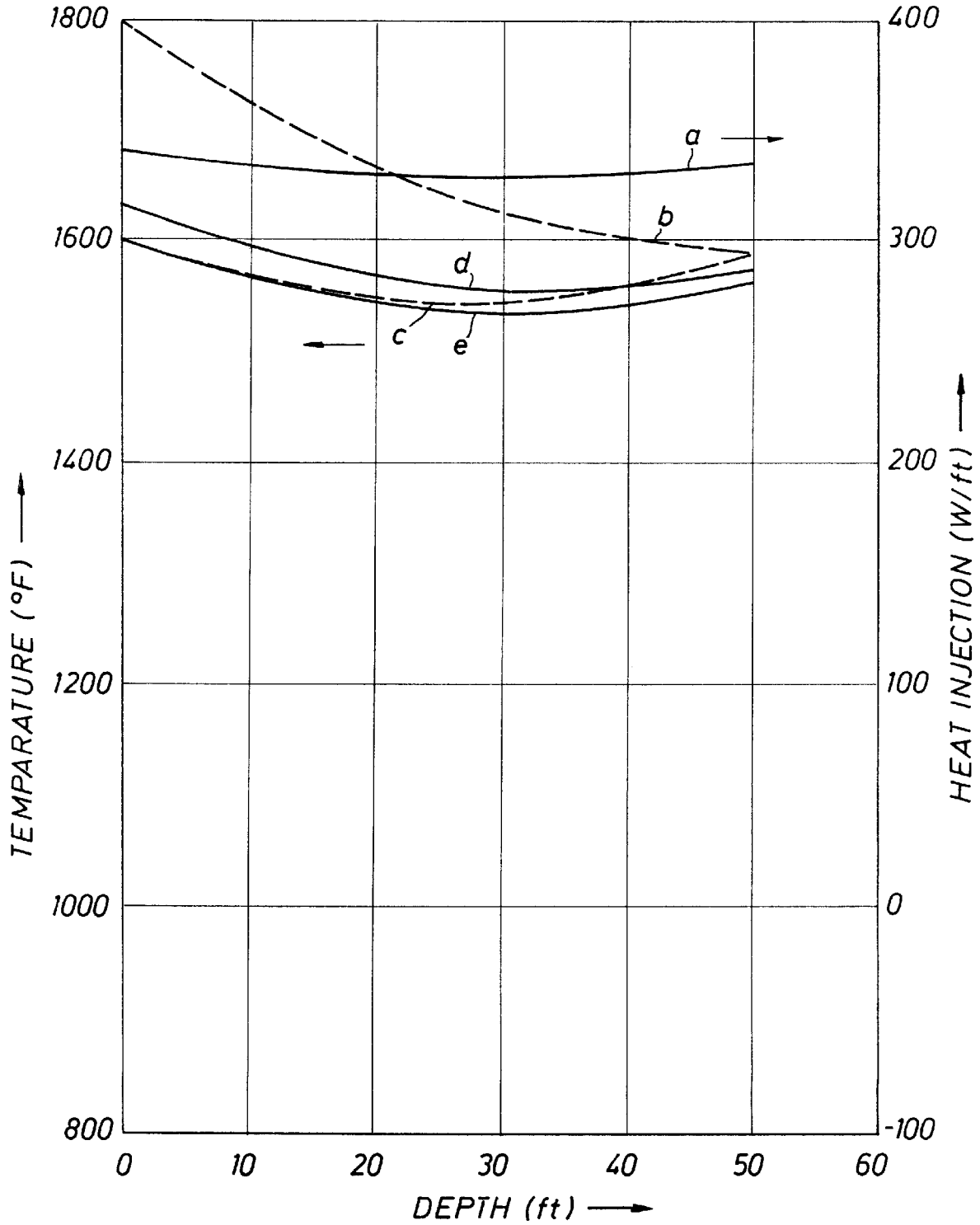
FIG. 6 is a plot of an exemplary temperature distribution for a 50 ft heated zone.

Referring now to FIG. 6, a graph of calculated temperature distribution and heat injected for a 50 foot heated zone is shown. This graph is based on a one-dimensional numerical computation which includes turbulent convection from each gas stream to each wall, as well as radiation between the inner tube and the casing, and conduction from the casing to the earth formation. No heat losses occur at the bottom of the well. The earth formation upon which this calculation was based was an oil shale with 30 gallon/ton richness, and the data presented in the graph represent the transient results after about one year heating. The casing has an outer diameter of 4.000 inch, an inner diameter of 3.548 inches, and the air line has an outer diameter of 2.875 inches and an inner diameter of 2.469 inches. The mass flow of combustion gases is 1200 lbm/hr. Curve (a) represents the heat injected, which is nearly constant at 325 Watts/ft over the fifty foot target zone. Curve (b) is the inlet gas temperature, which enters the target zone at 1800° F. and decreases to about 1600° F. at the bottom. Curve (c) is the return gas temperature, which leaves the target zone at 1600° F. Curves (d) and (e) represent the air line and casing temperatures, respectively. The casing temperature never exceeds 1600° F., while the combustion gas flowpath tubular temperature is only slightly greater. This is because of very high radiant and convective heat transfer between the air line and the casing.

Figure 7:
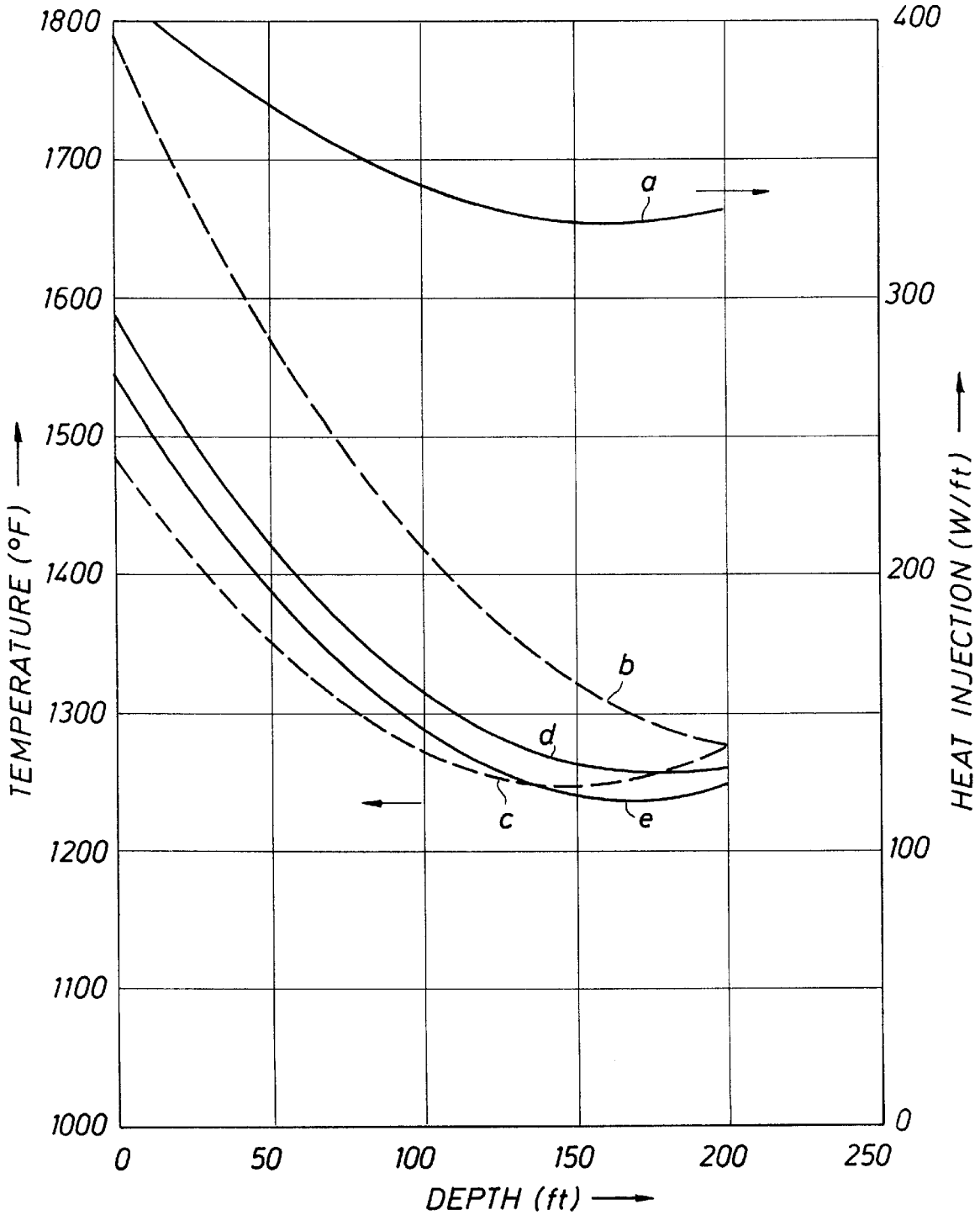
FIG. 7 is a plot of an exemplary temperature distribution for a 200 ft heated zone.

Referring now to FIG. 7, a plot of calculated temperature distribution and heat injected for a 200 foot heated zone is shown. Because of the longer target interval, the casing and combustion gas flowpath tubular must be larger to keep compression costs from becoming excessive. The casing has an outer diameter of 8.875 inches, an inner diameter of 8.097 inches, and the combustion gas flowpath conduit has an outer diameter of 5.000 inches and an inner diameter of 4.560 inches. The mass flow is 2768 lbm/hr. The mass flow increased to maintain a uniform temperature over the longer target zone. As shown in FIG. 7, curve (a) represents the heat injected, which decreases from 425 Watts/ft at the top of the target to about 360 Watts/ft near the bottom of the 200 foot target zone. Although there is some change in heat injected over the target zone, this is unexpectedly uniform for such a long length. Again, this is due to the high mass flow, concentric tubulars, and having the hot inlet gases in the inside tubular of the concentric tubulars. Curve (b) is the inlet gas temperature, which enters the target zone at 1800° F. and decreases to about 1275° F. at the bottom. Curve (C) is the return gas temperature, which leaves the target zone at 1480° F. Curves (d) and (e) are the combustion gas flowpath tubular and casing temperatures, respectively. The casing temperature never exceeds 1540° F., and the combustion gas flowpath tubular temperature never exceeds 1480° F. The incoming combustion gas is over 200° F. hotter than the metal temperatures at the top of the target zone.

The heat injection profile in the wellbore could be made more uniform by use of electrical heaters to supplement heat transferred from the combustion gases.

Electrical heaters may also be utilized with the practice of the present invention to extend the depth to which heat is economically transferred to the formation. Injection of heat using only combustion gases to depths of greater than about 200 to 400 feet may be relatively expensive. This expense is due to either a relatively large diameter of boreholes and casings, and/or compression costs required to transfer heat over the large distance. Electrical heaters could be added below the depth to which the combustion heater of the present invention can be economically utilized.

Flows of air and fuel into a system of heaters wells could be controlled by a system controller, which may be a PLC (programmable logic controller), a computer, or other control device. Inputs to the system controller may include temperature data from each of the wells in the pattern, flame-out detector outputs from each burner, and oxygen and/or carbon monoxide measurements in the stack, and stack exhaust temperature. Outputs may include control signals to an inlet air flow control valve for the pattern, which determines overall air flow, and control signals to fuel flow control valves for each burner, and optionally, control signals to ignitors for each burner. The system controllers may be operational for normal operation, or may handle start-up control.

In a start-up mode, after establishing air flow through the pattern, the system controller may light each burner and check for existence of flames. It may then verify complete combustion at all the burners by indications from oxygen and carbon monoxide sensors in the stack. The system controller may then increase in a stepwise manner the fuel to each burner until the fuel set point (or temperature set point) is reached. This fuel set point is based on a calculation using quasi-steady state conditions, such as those hereinabove. If the temperature sensor in any well exceeds the maximum temperature set point, the fuel injected at that burner may be decreased by the system controller. Similarly, the oxygen level must remain above a few percent or the fuel to each of the burners will be reduced. The fuel flow control valves should be designed to have substantial overcapacity, which allows the wells downstream of an inoperative burner to compensate by burning additional fuel and also allows initial startup of a pattern using one burner at a time, if desired. Considerable feed-forward control could be used to anticipate changes in fuel and air requirements throughout the system as other variables change.

If a flameout is detected on any burner, a warning signal can be activated by the system controller. However, as shown above, there is less than a 300° F. temperature drop in a heater well between the gases entering the target zone and that leaving the target zone. Thus if a particular burner becomes inoperative, such as due to orifice plugging, the downhole temperature in that well will not decrease more than 300° F. from its normal operating temperature of about 1600° F. Thus the pattern can continue to heat the earth formation even if one or more burners become inoperative. The other burners will be able to burn more fuel to keep their temperatures at normal operating conditions, and because they may be temperature controlled, over time may inject extra heat into the formation to partially compensate for the loss of other burners in the pattern. This redundancy is of particular importance when hundreds or thousands of heater wells are operating simultaneously.

Other variations of this invention include, for example, that the wells in the heater pattern may not all be identical, but may increase in diameter as the pressure and gas density are reduced. Thus the first heater well after the heat exchanger may use smaller diameter tubulars than the last heater well. Similarly, the inner or outer tubulars or both in a particular well can vary in diameter down the length of the well so as to minimize the total of compression and equipment present value costs and promote more uniform temperature profiles. For example, the inner tubular may begin as smaller diameter near the surface and gradually increase in diameter toward the bottom of the well as the pressure and gas density decrease. Another advantage of this design is that metal surfaces are closer at the bottom of the well so that the temperature difference between the casing and the combustion gas flowpath tubular is less.

Another variation of the present invention is that the flow direction in the heater well may be reversed, where the flow is down the outer annulus and up the inner tubular. In this case, the telescoping of the tubulars would be the opposite (the inner tubular would be smaller at the bottom of the well). This results in less hanging weight on the inner tubular and less creep at high temperatures.

Another variation of the present invention is that some additional air can be added at each well head through a compressor. This would increase the number of gas-fired heater wells before the heat exchanger.

It is also not necessary that the heat exchanger only handle the exhaust from a single pattern of heater wells. The exhaust from multiple patterns could be collected and exhausted to a larger heat exchanger.

Other working gases can be used in this invention besides air and natural gas. For example, rather than air, oxygen or oxygen enriched air could be used as the oxidant. This would maximize the number of heater wells that can be interconnected before the heat exchanger and minimize overall mass flow in the system in addition to eliminating nitrogen oxide emissions. Similarly, hydrogen could be used as the fuel instead of methane. Use of hydrogen as a fuel has the advantage of eliminating carbon dioxide and carbon monoxide emissions at the site of the well heaters. Other fuels such as, for example, propane, butane, gasoline, or diesel, are also possible.

If the working gases consist only of oxygen as the oxidant and hydrogen as the fuel, then the only combustion product will be water vapor. The water vapor may be condensed and removed periodically which would allow a very long chain of burners. In addition, the combustion would be completely free of chemical environmental emissions. One possibility for a completely environmentally non-polluting system is to use solar power to electrolyze the condensed water from the pattern to make the hydrogen and oxygen working gases.

Still another variation of the present invention combines the surface gas-fired heater with a downhole electrical heater whose heat injection is tailored to compensate for the small decrease in heat injectivity with depth due to the surface heater alone. Thus most of the energy for heating the ground is from natural gas and only a small fraction from electrical heat. The electrical heater may consist of a mineral-insulated heater cable with a resistive central conductor, such as that sold by BICC of Newcastle, UK; nichrome wire heater with ceramic insulators, such as that sold by Cooperheat, Inc. of Houston, Tex.; or other known electric heater designs. In a preferred embodiment of the present invention, the inner tubular itself is used as the electric heater. Current can flow down the inner tubular to a contactor at the bottom of the heater well and then returns to the surface on the casing. The inner tubular is a thin walled high temperature metal alloy with high electrical resistivity and with a wall thickness tailored to supply the heat injectivity profile desired. Ceramic spacers made, for example, of machinable alumina, are required to prevent the inner tubular from shorting to the casing except at the bottom contactor.

Besides oil recovery and soil remediation, other applications of the heaters of the present invention exist. For example, the present invention can be used in process heating, sulfur mining, heating of vats, or furnaces.

We claim:

1. A method to heat a formation, the method comprising the steps of:

providing a plurality of wellbores within the formation to be heated, each of the wellbores comprising a combustion gas flowpath through which a fluid can be routed, the combustion gas flowpath having an inlet and an outlet;

supplying to an inlet of a first wellbore combustion gas flowpath a flow of air;

burning an amount of fuel in the flow of air, thereby forming a stream of combustion products, the amount of fuel resulting in the stream of combustion products being at a first initial temperature;

passing the stream of combustion products through the first wellbore combustion gas flowpath, thereby transferring heat from the stream of combustion products to the formation, and decreasing the temperature of the stream of combustion products from the first initial temperature to a first final temperature;

routing the stream of combustion products to a second wellbore combustion gas flowpath inlet;

burning a second amount of fuel in the stream of combustion products, thereby forming a second stream of combustion products, the second amount of fuel resulting in the second stream of combustion products being at a second initial temperature; and passing the second stream of combustion products through the second wellbore combustion gas flowpath, thereby transferring heat from the second stream of combustion products to the formation, and decreasing the temperature of the second stream of combustion products from the second initial temperature to a second final temperature.

2. The method of claim 1 further comprising the steps of:

providing at least three wellbores within the formation to be heated, each of the wellbores comprising a combustion gas flowpath through which a fluid can be routed, the combustion gas flowpath having an inlet and an outlet;

routing the second stream of combustion products to a third wellbore combustion gas flowpath inlet;

burning a third amount of fuel in the second stream of combustion products, thereby forming a third stream of combustion products, the third amount of fuel resulting in the third stream of combustion products being at a third initial temperature; and passing the third stream of combustion products through the third wellbore combustion gas flowpath, thereby transferring heat from the third stream of combustion products to the formation, and decreasing the temperature of the third stream of combustion products from the third initial temperature to a third final temperature.

3. The method of claim 1 wherein the formation is below an overburden, the inlet and outlet of the flow path are above the overburden, and the combustion gas flowpath comprises a tubular within the wellbore extending through the overburden and formation and an annular volume outside of the tubular.

4. The method of claim 3 wherein the combustion gas flowpath inlet is at the inlet to the tubular, and the combustion gas flowpath outlet is at the top of the annular volume.

5. The method of claim 1 wherein the first initial temperature is between about 1400° F. and about 2000° F.

6. An apparatus to heat a formation comprising:

a plurality of wellbores extending from grade level above the formation to the formation, each of the wellbores comprising a combustion gas flowpath from an inlet at grade level, through a substantial portion of the wellbore, and back to an outlet at grade level;

a burner at the inlet of at least one combustion gas flowpath, the burner capable of producing a first combustion gas stream the burner having a combustion gas outlet in communication with the wellbore combustion gas flowpath inlet;

a combustion gas conduit in communication with the wellbore combustion gas flowpath outlet; and a second burner, the combustion conduit providing communication to the second burner, and the second burner capable of producing a second combustion gas stream, by combustion of a fuel with the first combustion gas stream, and the second burner having a combustion gas outlet in communication with a second wellbore combustion gas flowpath inlet.

7. The apparatus of claim 6 further comprising:

at least three wellbores extending from grade level above the formation to the formation; each of the wellbores comprising a combustion gas flowpath from an inlet at grade level, through a substantial portion of the wellbore, and back to an outlet at grade level;

a second combustion gas conduit in communication with the second wellbore combustion gas flowpath outlet; and a third burner, the second combustion conduit providing communication to the third burner, and the third burner capable of producing a third combustion gas stream, by burning a fuel with the second combustion gas stream, and the third burner having a combustion gas outlet in communication with a third wellbore combustion gas flowpath inlet.

8. The apparatus of claim 6 further comprising a heat exchanger to exchange heat between combustion air of the first burner and combustion gas from an outlet of another wellbore.

9. The apparatus of claim 6 wherein the formation is below an overburden, the inlet and outlet of the combustion gas flowpath are above the overburden, and the combustion gas flowpath comprises a tubular within the wellbore extending through the overburden and formation, and an annular volume outside the tubular.

10. The apparatus of claim 9 further comprising insulation between the volume within the tubular and the volume of the annular volume outside of the tubular in the wellbore within the overburden.

11. The apparatus of claim 9 wherein the wellbore within the overburden is a cased wellbore, and the cased wellbore is cemented in the overburden with an insulating wellbore cement.

12. The apparatus of claim 6 wherein the wellbore within the formation to be heated is a cased wellbore, and the cased wellbore is cemented in the formation with a high alumina wellbore cement.

* * * * *